US007841329B2

(12) United States Patent
Yang

(10) Patent No.: US 7,841,329 B2
(45) Date of Patent: Nov. 30, 2010

(54) MANUALLY AND ELECTRICALLY ACTUATING TOY GUN STRUCTURE

(76) Inventor: Chung-Kuan Yang, No. 82, Jen-Hua St., San-Chung City, Taipei County (TW)

( * ) Notice: Subject to any disclaimer, the term of this patent is extended or adjusted under 35 U.S.C. 154(b) by 202 days.

(21) Appl. No.: 12/265,884

(22) Filed: Nov. 6, 2008

(65) Prior Publication Data

US 2010/0065032 A1 Mar. 18, 2010

(30) Foreign Application Priority Data

Sep. 12, 2008 (TW) ..... 97135253 A

(51) Int. Cl.
*F41B 11/00* (2006.01)

(52) U.S. Cl. ..... 124/66

(58) Field of Classification Search ..... 124/63–68
See application file for complete search history.

(56) References Cited

U.S. PATENT DOCUMENTS 5,261,384 A * 11/1993 Hu ..... 124/66
6,564,788 B1 * 5/2003 Hu ..... 124/66
7,100,592 B1 * 9/2006 Yang ..... 124/67
2005/0000505 A1 * 1/2005 Pedicini et al. ..... 124/63
2006/0231083 A1 * 10/2006 Tsurumoto ..... 124/66
2007/0289586 A1 * 12/2007 Tsurumoto ..... 124/73

* cited by examiner

*Primary Examiner*—Troy Chambers
(74) *Attorney, Agent, or Firm*—WPAT, PC; Justin King

(57) ABSTRACT

A manually and electrically actuating toy gun structure includes a gun shell, a trigger, a gun machine core tube, and a piston. The control structure includes a first interlocking rod, a first push member, a second interlocking rod, a transmission set, a triggering device, a gun shell, and a push-and-propping-up block. One end of the first interlocking rod has a connecting pin interlocking with the first push member. The other end of the first interlocking rod has a connecting hole connecting to the trigger and being driven to slide along the x-direction. The hole of the first push member is connected to a connecting end of the first interlocking rod and is contacted with the push-and-pluck rod of the switch. The power supply of the electric motor is switched on when the first push member is driven by the first interlocking rod to push the push-and-pluck rod. The arcuate surface of the draw bar on the second interlocking rod performs action in corresponding with the interlocking salient pin of the first compound gear. When the power supply of the electric motor is switched on, the interlocking salient pin at the resilient cantilever of the first compound gear in the transmission set performs action making the piston of the triggering device to be driven backward and the gun machine core tube on the triggering device to be driven by the interlocking salient pin to displace backward that makes the bullets contained in the cartridge drop at the pre-determined position.

11 Claims, 11 Drawing Sheets

MANUALLY AND ELECTRICALLY ACTUATING TOY GUN STRUCTURE

BACKGROUND OF THE INVENTION

1. Field of the Invention

The invention relates to a manually and electrically actuating toy gun structure, and more particularly, to a manually and electrically actuating toy gun structure having both the manually and electrically driving of controlling structure.

2. Description of the Prior Art

Among the current common toy gun products having projectile plastic bullet, there are two types of structure: manual and mechanical structures. The pneumatic type of toy gun makes use of an attached air bottle for providing the high-pressure gas to generate pressure propelled plastic (PP) bullet for projecting off the bullets. However, the mechanical type of toy gun makes use of the resilient spring force released from the compressed spring for propelling a piston to generate high-pressure gas for projecting off the plastic bullets. Both types of toy gun have significant difference in structure since their power sources are different.

As far as the structure of the mechanical type of toy gun is concerned, a relatively simpler one propels the piston for compressing the spring by a manually pulling type of action. This kind of structure of the toy gun lacks of enjoyment while one is playing on the gun since it has only the function of a single shooting. However, there is another one which has both the functions of single shooting and continuous shooting through a switching action by the use of an electric power motor to compress the spring via the transmitting mechanism to drive the piston. This one is relatively enjoyable while one is playing on the gun. Nevertheless, as far as the current products are concerned, the way of driving exists only in a single state no matter whether it is a manual or electric motor's driving, and there are no such kinds of structure having both the manually and electrical motor's driving types of today. Consequently, the fact that the pneumatically driving toy gun is unable to function once the compressed air is used up forms a demerit upon usage, thereby it lacks product competitiveness on the market.

In addition, one of the prior art having the same inventor as the present invention is referring to the "Toy Gun Having Dual Actuating Manners" of Taiwan invention patent certificate No. 1264518 (U.S. Pat. No. 7,100,592; China Utility Model Patent No. 20050136485.3; Japan Utility Model Patent No. 2005-9770). This case of the prior art has already combined the manually actuating and electrically motor's actuating in a toy gun structure. In the case, the toy gun uses electric motor to actuate the control structure, the electric motor rotates to drive the third compound gear making the side salient pin push the L-shape draw bar in the gun machine core tube, and in sequence, to let the gas nozzle thereof constringe inward, thus the plastic bullets in the cartridge is capable of dropping at the pre-determined position in front of the gas nozzle. Thereafter, the thick gear of the third compound gear meshes with the lower rack. By making use of the driving of the third compound gear to let the piston persistently compress the compression spring until the thick gear of the third compound gear separate from the lower rack and have the "carving hollowed-out breach" correspond to the lower rack, the piston subjected to the resilient force of the piston spring is capable of rapidly compressing into the containing space of the gun machine core tube. Consequently, the air in the containing space subjected to the compression is capable of jetting off the gas nozzle and shooting off the bullets.

However, several situations might happen. First of all, it is apt to have the side salient pin push the L-shape draw bar of the gun machine core tube when the thick gear of the third compound gear is meshing with the lower rack. Secondly, when it comes to a sudden power off, the electric motor might persistently drive the third compound gear due to the inertial motion to rotate and separate from the pre-determined reverted position. What is more, the side salient pin of the third compound gear might hit the hook portion of the trigger causing reversed rotation and separate from the pre-determined reverted position. All of these situations will result in the fact that the thick gear does not completely mesh with the rack and creates catching condition, thereby the gun machine core tube is unable to completely go back to the reverted position. As a result, the toy gun will have the bullet catching or have two bullets shooting at a time.

SUMMARY OF THE INVENTION

In light of the above-mentioned disadvantages of the prior arts, the invention aims to ameliorate at least some of the disadvantages of the prior art or to provide a useful alternative.

The primary objective of the invention is to provide a manually and electrically actuating toy gun structure having both of the manually and electrically actuating methods, and more particularly, to provide a manually and electrically actuating toy gun structure that makes use of an interlocking salient pin furnished at the free end of a resilient cantilever on a first compound gear. By making use of the interlocking salient pin of the resilient cantilever, when the interlocking salient pin rotates in positive direction, it is capable of driving the triggering device to revert back to a positive action and while the interlocking salient pin rotates in reverse direction, it is capable of relieving the catching to assure that the first compound gear and the lower rack of the piston on the triggering device is capable of reverting back to a complete meshing.

In the second objective of the manually and electrically actuating toy gun structure of the invention, the bottom surface of the second push member being spread with high viscosity grease is exerted by the action of the fourth position-restoring spring. By making use of the hook portion to drive the push-and-pluck rod of the switch of the power supply to slowly slide in x-direction, one is capable of delaying the switch-off of the power supply. In this way, the interlocking salient pin is capable of avoiding instantly stopping action to prevent the meshing between the half-gear of the first compound gear and the lower rack of the piston from mutually catching which may result in the inability of reverting position.

To achieve the above-mentioned objective, the invention provides a manually and electrically actuating toy gun structure that includes a gun shell, a trigger, a gun machine core tube, and a piston. The control structure includes a first interlocking rod, a first push member, a second interlocking rod, a transmission set, a triggering device, a gun shell, and a push-and-propping-up block. One end of the first interlocking rod has a connecting pin interlocking with the first push member. The other end of the first interlocking rod has a connecting hole connecting to the trigger and being driven to slide along the x-direction. The hole of the first push member is connected to a connecting end of the first interlocking rod and contacts with the push-and-pluck rod of the switch. The power supply of the electric motor is switched on when the first push member is driven by the first interlocking rod to push the push-and-pluck rod. The arcuate surface of the draw bar on the second interlocking rod performs action in corresponding with the interlocking salient pin of the first compound gear. When the power supply of the electric motor is switched on, the interlocking salient pin at the resilient cantilever of the first compound gear in the transmission set performs action making the piston of the triggering device to be driven backward and the gun machine core tube on the triggering device to be driven by the interlocking salient pin to displace backward too that makes the bullets contained in the cartridge drop at the pre-determined position. When the lower rack under the piston separates from the first compound gear, the piston returns back to the original position and pushes out the compressed air to shoot off the bullet. On the other hand, when the power supply of the electric motor is turned off making the first compound gear generate reversed rotation due to the inertial motion, the interlocking salient pin is capable of relieving the catching with the draw bar to make the first compound gear positively mesh with the lower rack.

The accomplishment of this and other objectives of the invention will become apparent from the following description and its accompanying drawings of which:

DETAILED DESCRIPTION OF THE PREFERRED EMBODIMENT

Figure 1A:
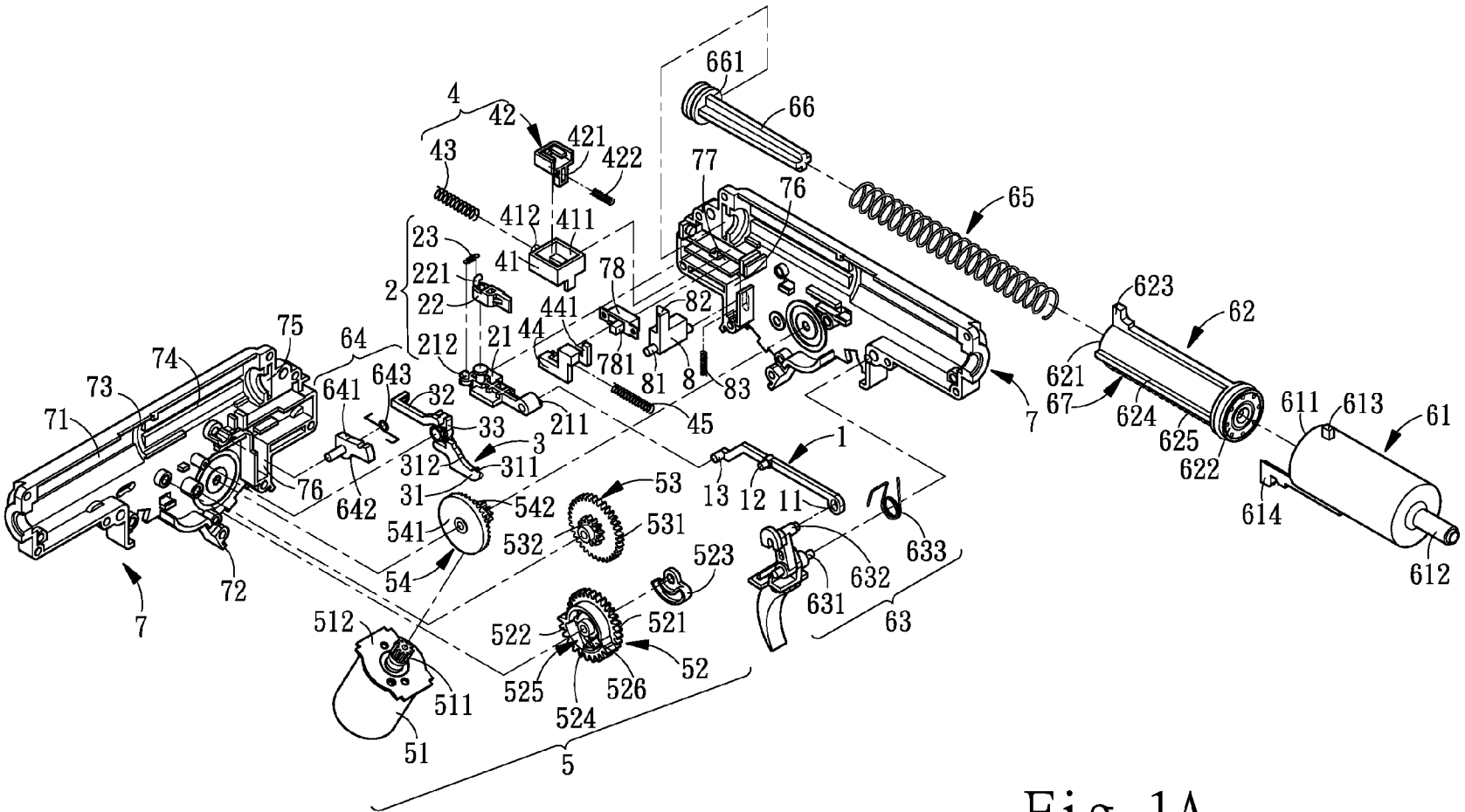
FIG. 1A is an isometric and exploded view of the manually and electrically actuating toy gun structure of the invention.
Figure 1B:
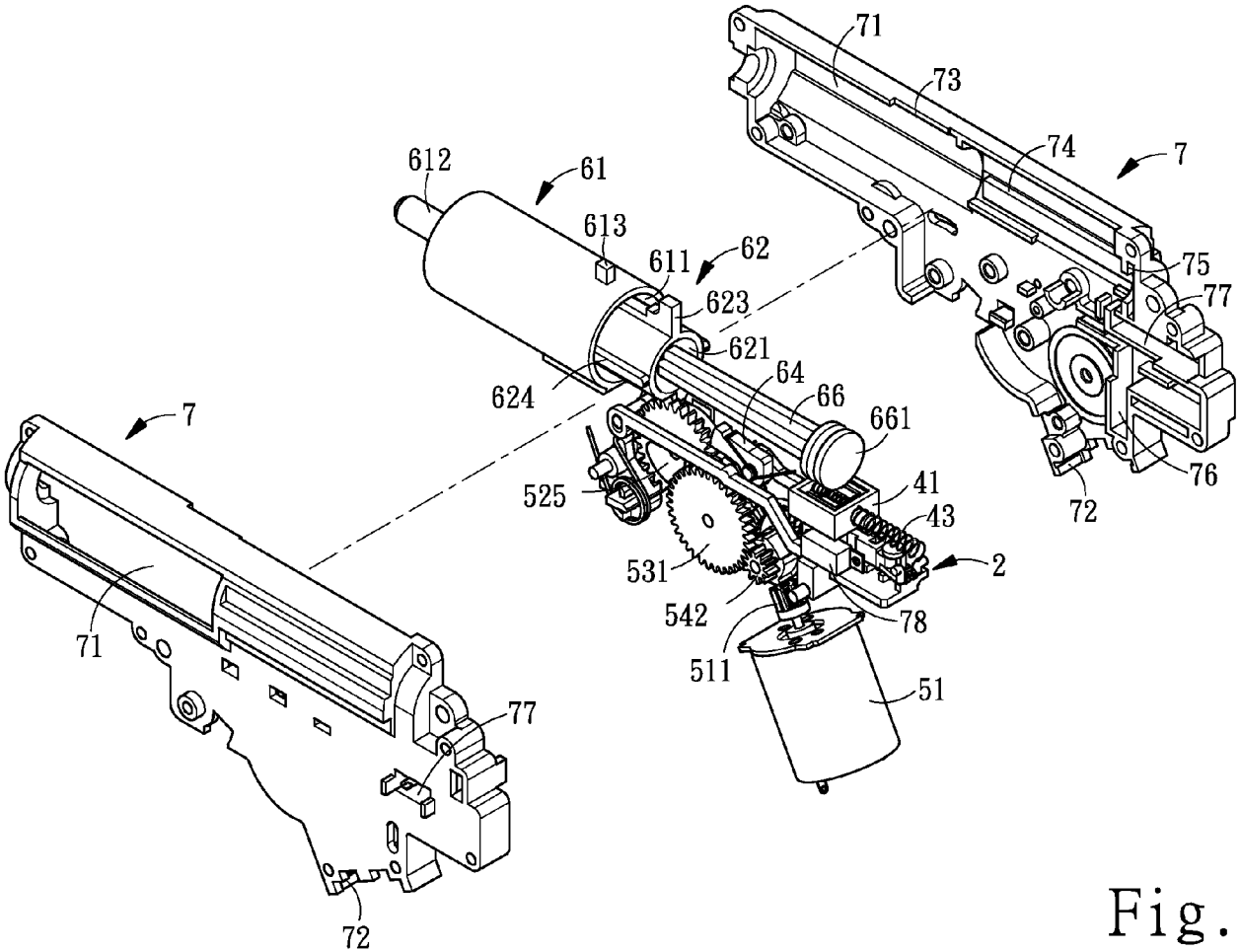
FIG. 1B is an isometric assembling view of the manually and electrically actuating toy gun structure of the invention.

FIG. 1A is an isometric and exploded view of the manually and electrically actuating toy gun structure of the invention; FIG. 1B is an isometric assembling view of the manually and electrically actuating toy gun structure of the invention. As shown in FIG. 1A, the manually and electrically actuating toy gun structure of the invention, in most parts, being the same as the "Toy Gun Having Dual Actuating Manners" of Taiwan invention patent certificate No. 1264518 (U.S. Pat. No. 7,100,592; China Utility Model Patent No. 20050136485.3; Japan Utility Model Patent No. 2005-9770) includes members of a gun shell (7), a trigger (63), a gun machine core tube (61), and a piston (62) etc. The manually and electrically actuating toy gun structure of the invention further includes a first interlocking rod (1), a first push member (2), a second interlocking rod (3), a second push member (4), a transmission set (5), a triggering device (6), a gun shell (7), and a push-and-propping-up block (8). The first interlocking rod (1) includes a connecting hole (11), a first salient pin (12), and a connecting pin (13) where the connecting hole (11) of the first interlocking rod (1) is connected to a connecting post (632) of the trigger (63) while the first salient pin (12) is in contact with a slant surface (642) of a pivoting block (64).

The first push member (2) includes a connecting slider (21), a push-and-pluck member (22), and a first position-restoring spring (23) where the connecting slider (21) having a hole (211) at the front end thereof is connected to the connecting pin (13) of the first interlocking rod (1), the push-and-pluck member is pivotally connected to the connecting slider (21), while the first position-restoring spring (23) is hooked to the connecting slider (21) as well as the hook portions (212), (221) of the push-and-pluck member (22).

The second interlocking rod (3) includes a draw bar (31), a push rod (32), and a connecting rod (33) where the draw bar (31) has a hook portion (311) and an arcuate surface (312), the connecting rod (33) having the draw bar (31) and the push rod (32) at both ends thereof is pivotally connected to the gun shell (7) making the draw bar (31) and the push rod (32) move in opposite x-direction. What is more, the hook portion (311) is positioned at an end of the arcuate surface (312).

The second push member (4) includes an interlocking slider (41), a push-and-pluck block (42), a second position-restoring spring (43), a slider (44), and a fourth position-restoring spring (45) where the interlocking slider (41) has a containing trough (411) and a salient post (412); the push-and-pluck block (42) being positioned within the containing trough (411) has a plucking rod (421), which is extended out of the interlocking slider (41), and a third position-restoring spring (422) while the second position-restoring spring (43) has an end slipped on the salient post (412) and the other end propped up against the corresponding portion of the gun shell (7). Moreover, both ends of the third position-restoring spring (422) are propped up against the walls between the push-and-pluck block (42) and the interlocking slider (41) respectively while the slider (44) being appeared in stepped-shape design has a hook portion (441) furnished at the upper end thereof and a fourth position-restoring spring (45) furnished correspondingly in the center portion thereof.

The transmission set (5) includes an electric motor (51), a first compound gear (52), a second compound gear (53), and a third compound gear (54). The electric motor (51) has a transmission gear (511) furnished at the front end thereof and is mounted at a motor connecting end (72) of the gun shell (7) through a plug-in portion (512). The third compound gear (54) has a perpendicular gear (541) which meshes with the transmission gear (511) of the electric motor (51) and a front gear (542) which has a same shaft as that of the rectangular gear (541) and is furnished on a side thereof. The second compound gear (53) has a large gear (531) which is meshed with the front gear (542) of the third compound gear (54) and a small gear (542) which has a same shaft as that of the large gear (531) and is furnished on a side thereof. The first compound gear (52) has a thin gear (521), a half-gear (522), a reinforced block (523), a resilient cantilever (524), and an interlocking salient pin (526). The thin gear (521) being meshed with the pinion (532) of the second compound gear (53) has a carving hollowed-out portion (525) that is opposite to the resilient cantilever (524). The half-gear (522) which is adjacent to the carving hollowed-out portion (525) has a teeth portion on a side, a smooth arcuate piece on the other side, and a slot formed between them and having the resilient cantilever (524) positioned therein. The inter-locking salient pin (526) is positioned at the free end of the resilient cantilever (524). As the first compound gear (52) rotates, the teeth portion of the half-gear (522) is capable of meshing with a lower rack (625) of the piston (62) while the reinforced block (523) being furnished in the carving hollowed-out portion (525) is for strengthening the stiffness of the thin gear (521).

The triggering device (6) includes a gun machine core tube (61), a piston (62), a trigger (63), a pivoting block (64), a piston spring (65), and an inner inserting rod (66). The gun machine core tube (61) includes a piston containing space (611), a gas nozzle (612), a salient portion (613), and an L-shape draw bar (614). The gun machine core tube (61) having an open end of the piston containing space (611) at an end and a gas nozzle (612) penetrated and extended-out of the gun shell (7) at the other end is contained in the carving hollowed-out portion (71) of the gun shell (7). In addition, the gun machine core tube (61) also has a salient portion (613) and the L-shape draw bar (614) furnished at the periphery thereof. The salient portion (613) being furnished at a front guiding slot (73) of the gun shell (7) forms an action limit.

The piston (62) includes an inserting rod containing space (621), a piston washer (622), a check salient portion (623), at least a rib (624), and the lower rack (625). The piston (62) after having its front end combine with the piston washer (622) is inserted into the piston containing space (611) of the gun machine core tube (61). Besides, the inserting rod containing space (621) is positioned at the rear end of the piston (62), the check salient portion (623) is positioned at the periphery of the open end of the piston (62), as well as the rib (624) and the lower rack (625) is furnished at the outer periphery of the piston (62) and are extended in the axial x-direction. The inner inserting rod (66) has its one end furnish a ring flange (661) which is capable of embedding a positioning channel (75) to be positioned, and has its other end insert the inserting rod containing space (621) of the piston (62) after being penetrated a piston spring (65).

The trigger (63) having a connecting post (632) furnished above the trigger (63) is pivotally connected to the gun shell (7) through a rotating shaft (631) and a first torsional spring (633) which makes the trigger (63) keep a torsional resilient force. The pivoting block (64) being pivotally connected to the gun shell (7) under the piston (62) has a catch teeth portion (641), a slant surface (642), and a second torsional spring (643).

The gun shell (7) being combined by a pair of half-boring shells includes a carving hollowed-out portion (71), the motor connecting end (72), the front guiding slot (73), an inner guiding slot (74), a positioning slot (75), a control guiding slot (76), a switch containing chamber (77), and a switch (78). The carving hollowed-out portion (71) is positioned at the front end of the gun shell (7). The inner guiding slot (74) being positioned in the gun shell (7) is adjacent to carving hollowed-out portion (71). The front guiding slot (73) is positioned above a location which is in between the carving hollowed-out portion (525) and the inner guiding slot (74). The positioning slot (75) is furnished at an end of the inner guiding slot (74); the motor connecting end (72) is positioned at the bottom of the gun shell (7); the switch containing chamber (77) is positioned below the positioning slot (75); the control guiding slot (76) is positioned between the switch containing chamber (77) and the motor connecting end (72); while the switch (78) having a push-and-pluck rod (781) is contained in the switch containing chamber (77).

The push-and-propping-up block (8) includes a push-and-pluck salient block (81), a check portion (82). and a compression spring (83). The push-and-pluck salient block (81) being extended out from the control guiding slot (76) is positioned at the bottom side of the push-and-propping-up block (8) while the check portion (82) being positioned on the top of the push-and-propping-up block (8) is adjacent to and leaned against the first push member (2) and the second push member (4).

Figure 2A:
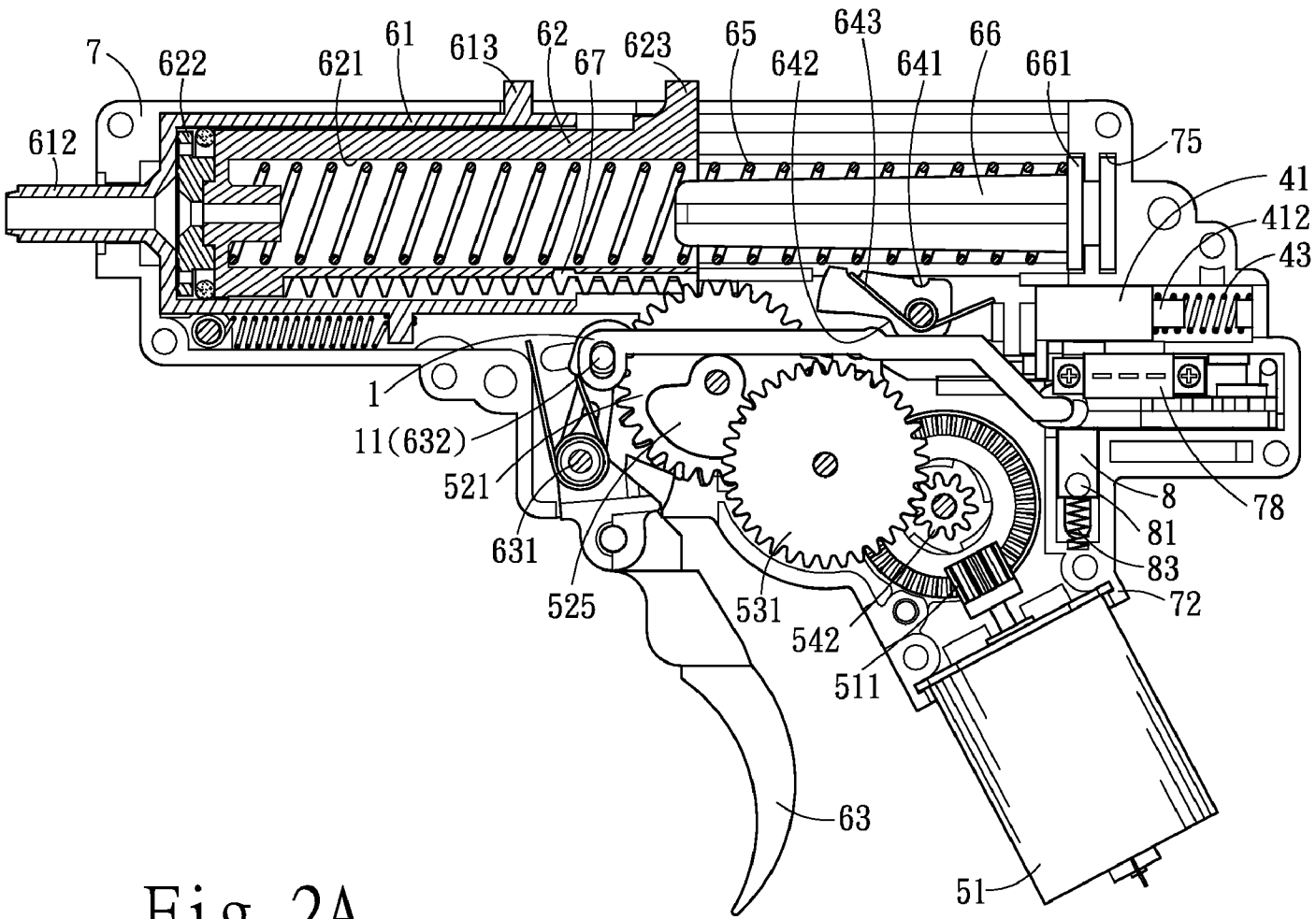
FIG. 2A is a fragmentary cross-sectional right-side view (I) of the manually actuating toy gun structure of the invention.
Figure 2B:
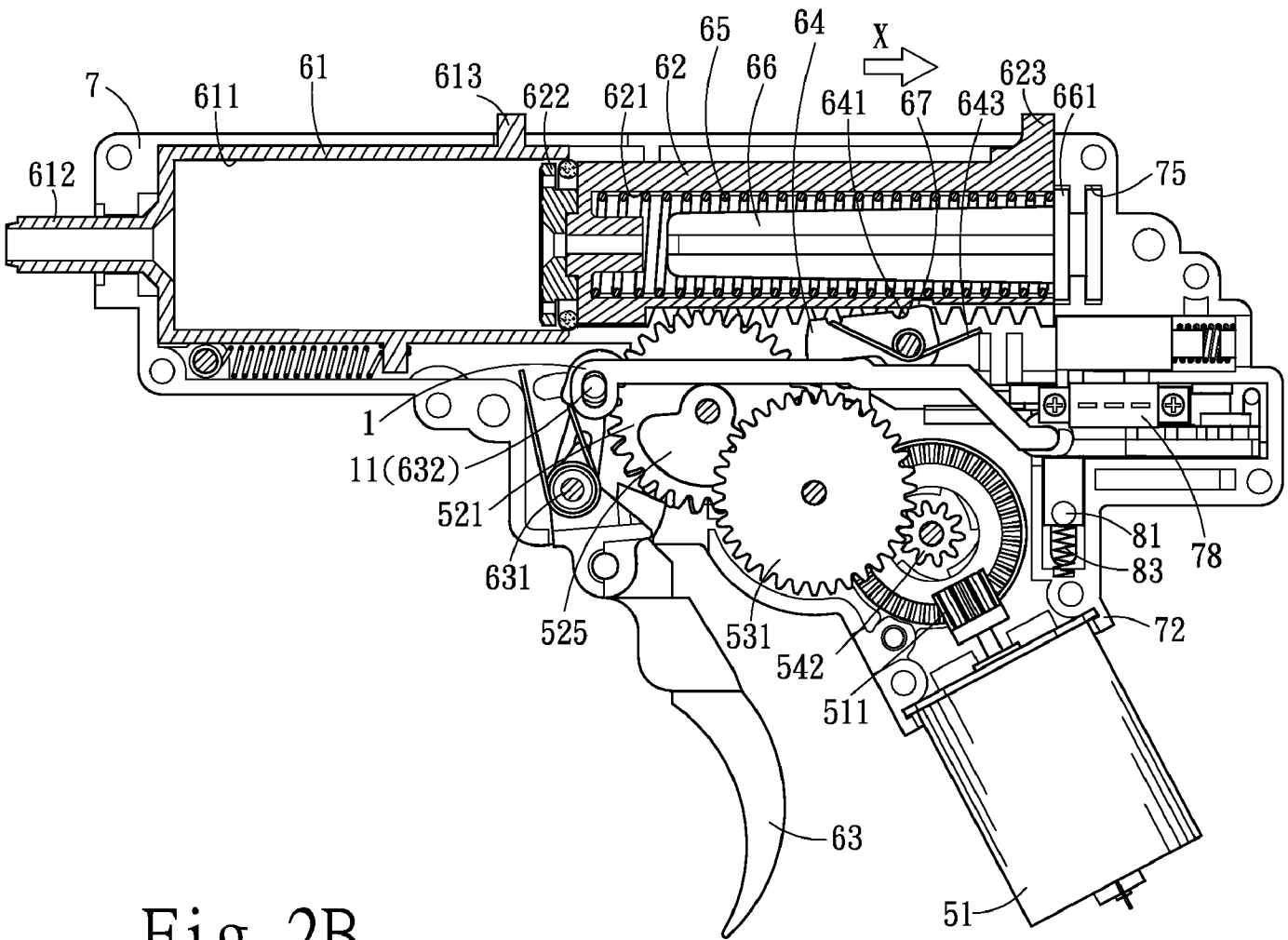
FIG. 2B is a fragmentary cross-sectional right-side view (II) of the manually actuating toy gun structure of the invention.
Figure 2C:
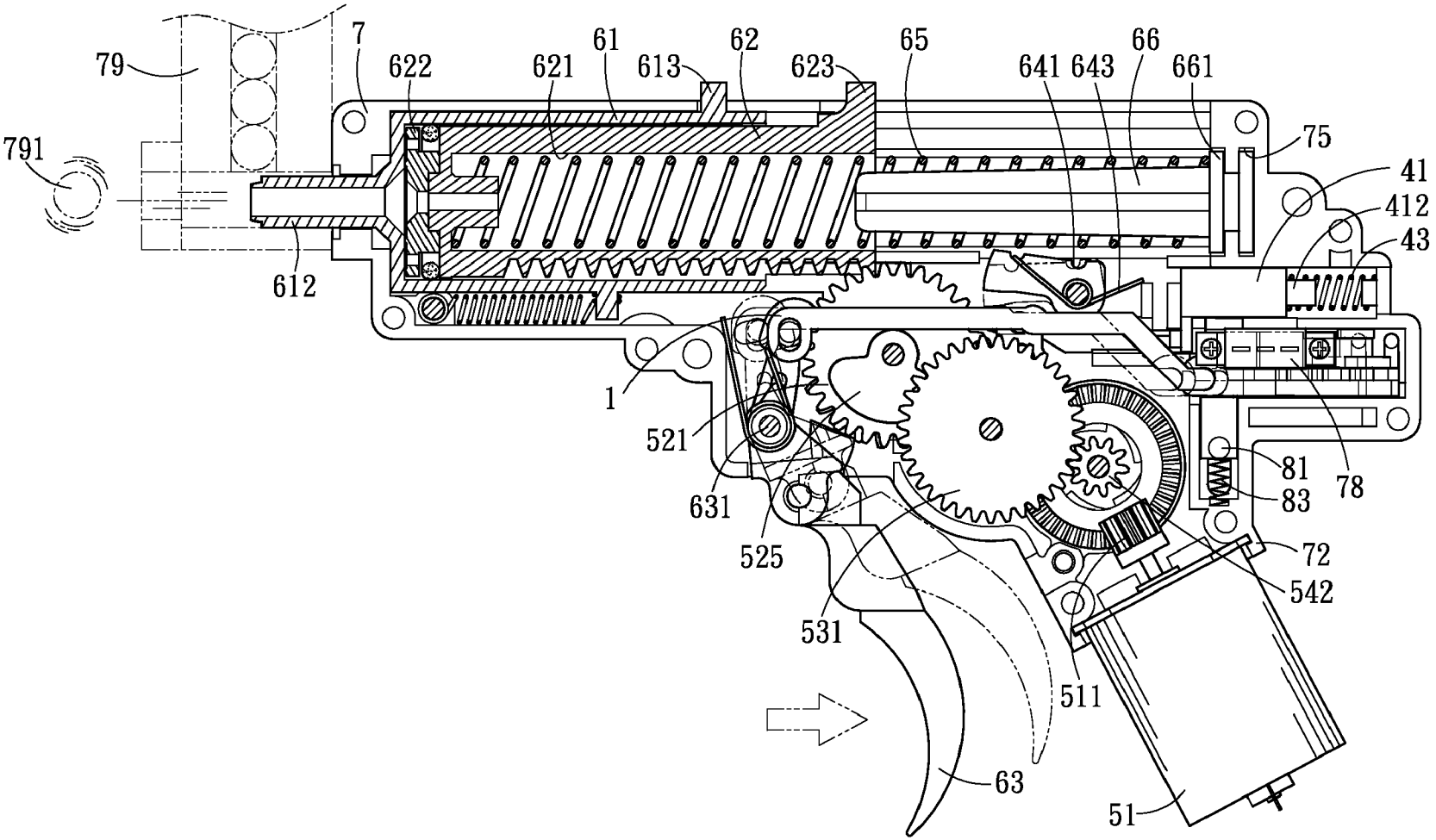
FIG. 2C is a fragmentary cross-sectional right-side view (III) of the manually actuating toy gun structure of the invention.

FIG. 2A is a fragmentary cross-sectional right-side view (I) of the manually actuating toy gun structure of the invention; FIG. 2B is a fragmentary cross-sectional right-side view (II) of the manually actuating toy gun structure of the invention; while FIG. 2C is a fragmentary cross-sectional right-side view (III) of the manually actuating toy gun structure of the invention. As shown in FIG. 2A, FIG. 2B and FIG. 2C, when it comes to assembling, after assembling the above-mentioned elements, as one manually pulls the check salient portion (623) to make the piston (62) to be drawn in axial x-direction to prop up to the positioning slot (75) of the gun shell (7), the piston (62) will compress the piston spring (65), and in the meantime, the catch slot (67) below it will catch and mesh the catch teeth portion (641) of the pivoting block (64) making the piston (62) secure in the back position as shown in FIG. 2B. When the trigger (63) is pulled, the connecting post (632) interlocks with the connecting hole (11) of the first interlocking rod (1) making the first interlocking rod (1) slide along the reverse axial x-direction. In the meantime, the first salient pin (12) on the first interlocking rod (1) props up the slant surface (642) of the pivoting block (64) making the catch teeth portion (641) separate from the catch slot (67). Afterwards, the piston (62) is pushed by means of the resilient force of the piston spring (65) making the compressed air within the gun machine core tube (61) jet propel off and shoot off the bullet (791) stored within the cartridge (79) which is positioned in front of the gas nozzle (612) of the gun machine core tube (61).

Figure 3A:
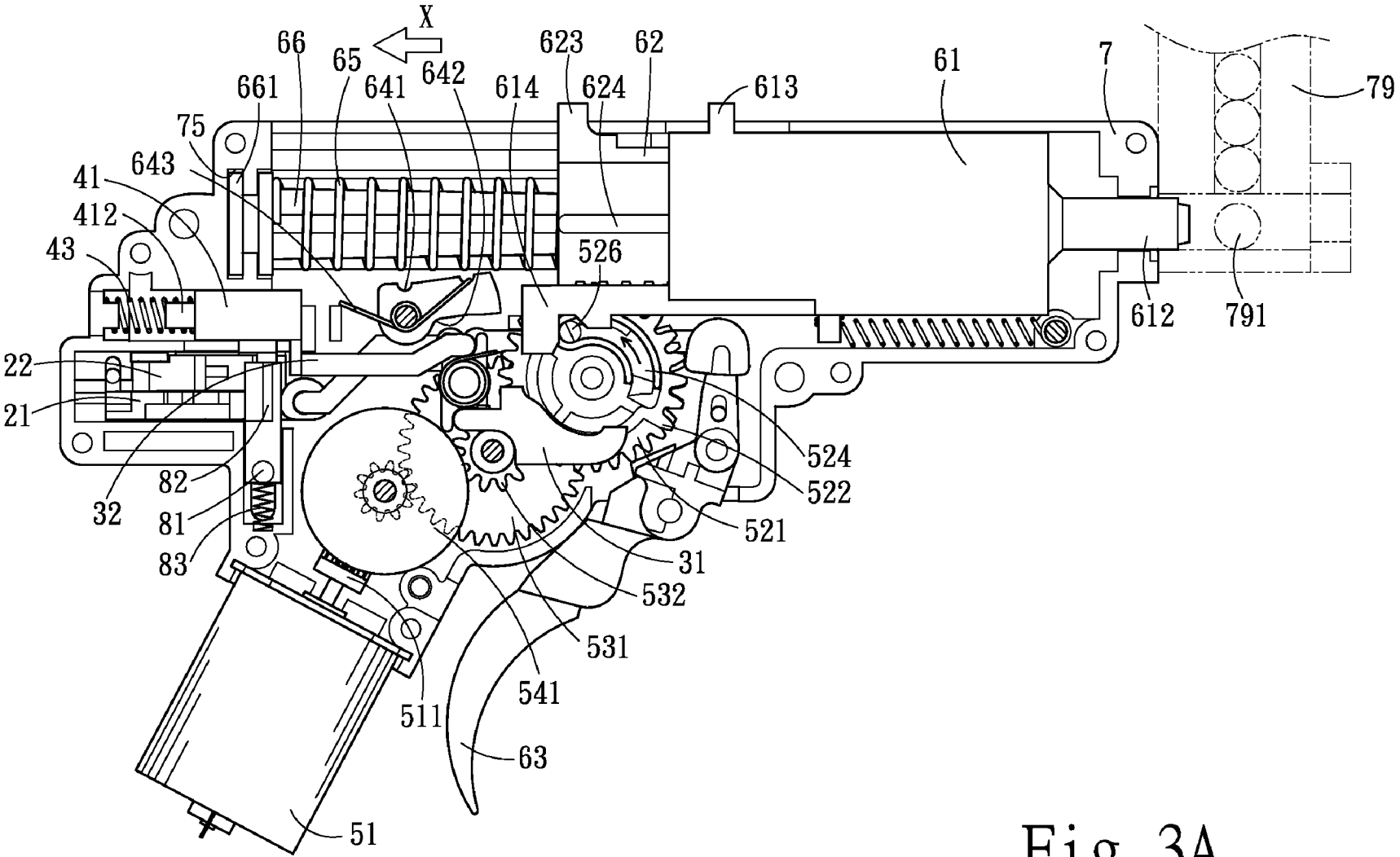
FIG. 3A is a fragmentary cross-sectional left-side view (I) of the electrically actuating toy gun structure of the invention.
Figure 3B:
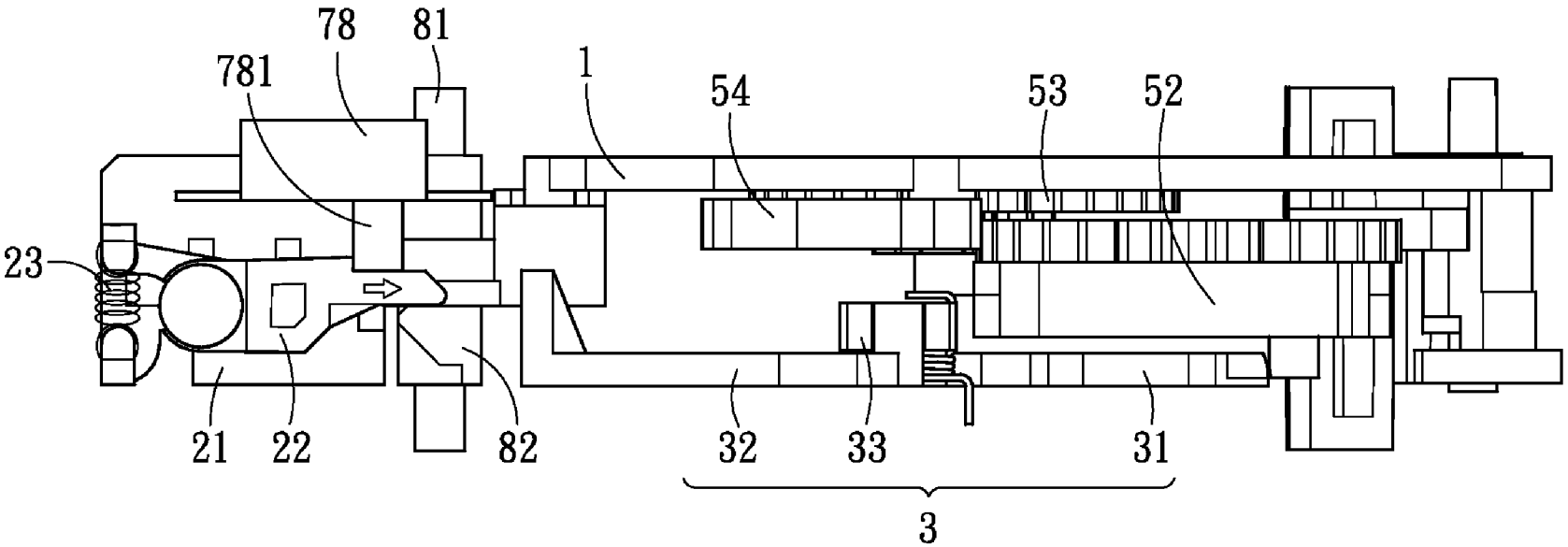
FIG. 3B is a fragmentary cross-sectional plan view of the electrically actuating toy gun structure of the invention.
Figure 3C:
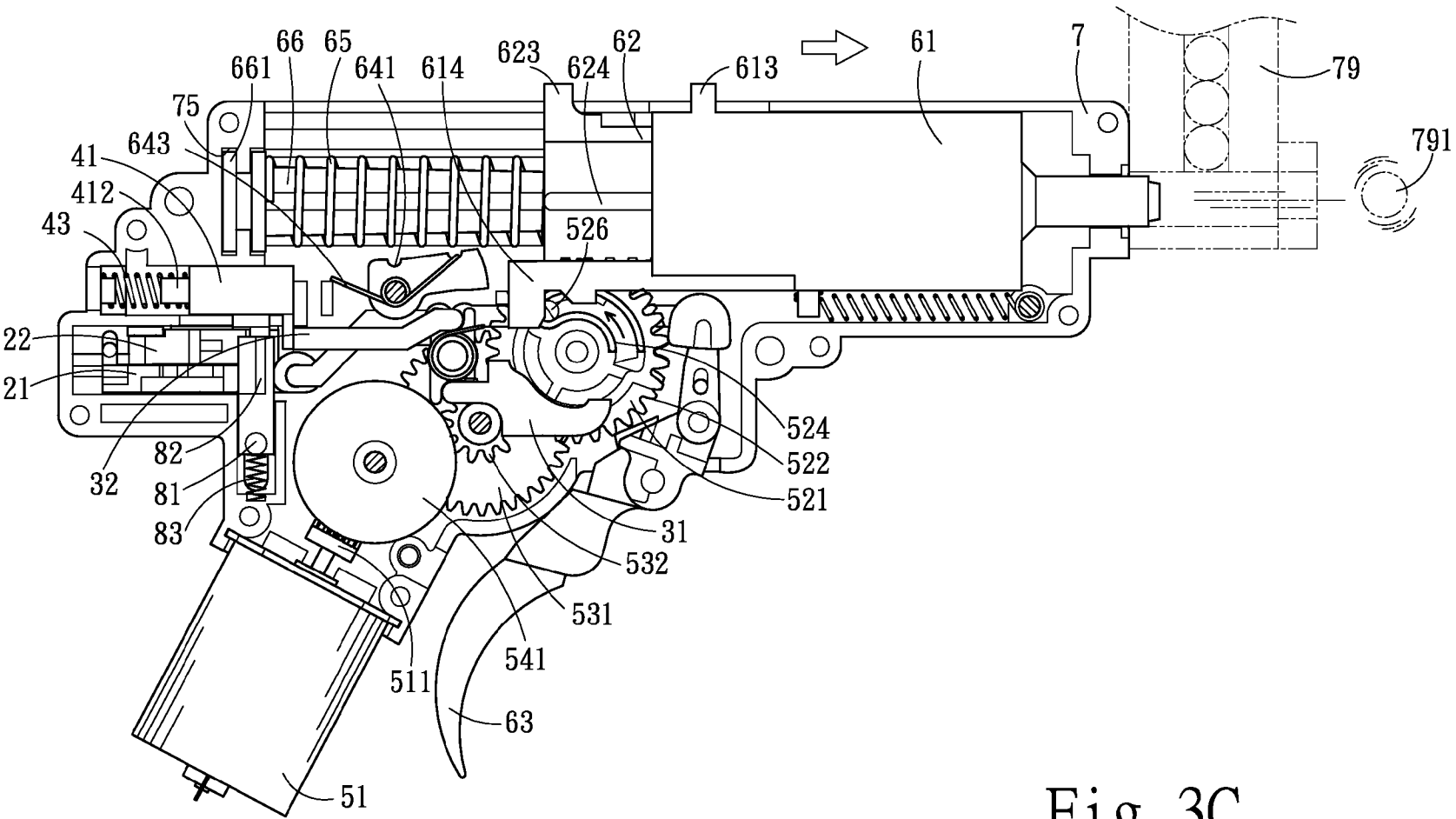
FIG. 3C is a fragmentary cross-sectional left-side view (II) of the electrically actuating toy gun structure of the invention.
Figure 3D:
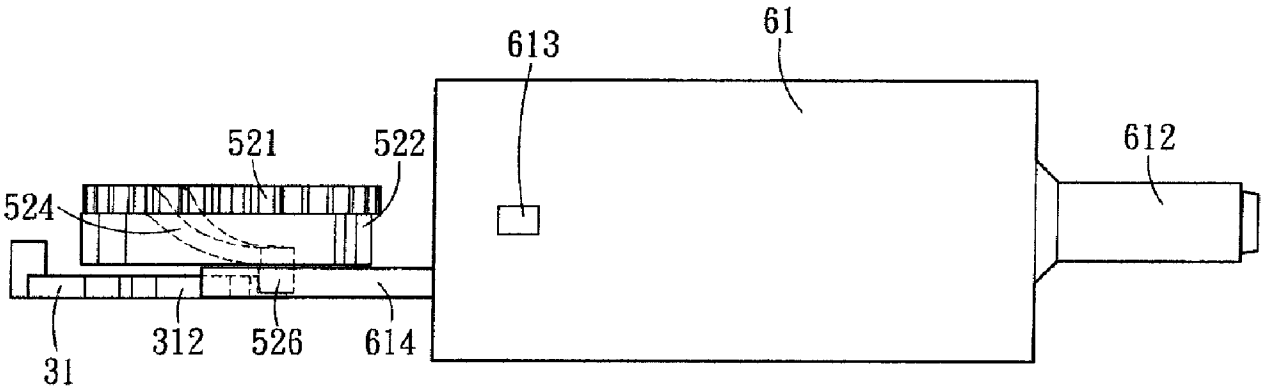
FIG. 3D is a plan view of the first compound gear and the second interlocking rod of the electrically actuating toy gun structure of the invention (I)
Figure 3E:
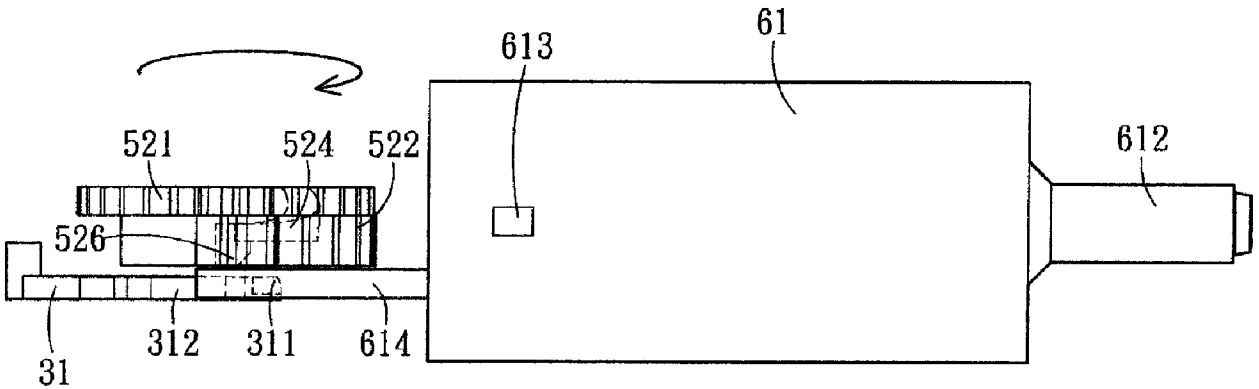
FIG. 3E is a plan view of the first compound gear and the second interlocking rod of the electrically actuating toy gun structure of the invention (II)
Figure 3F:
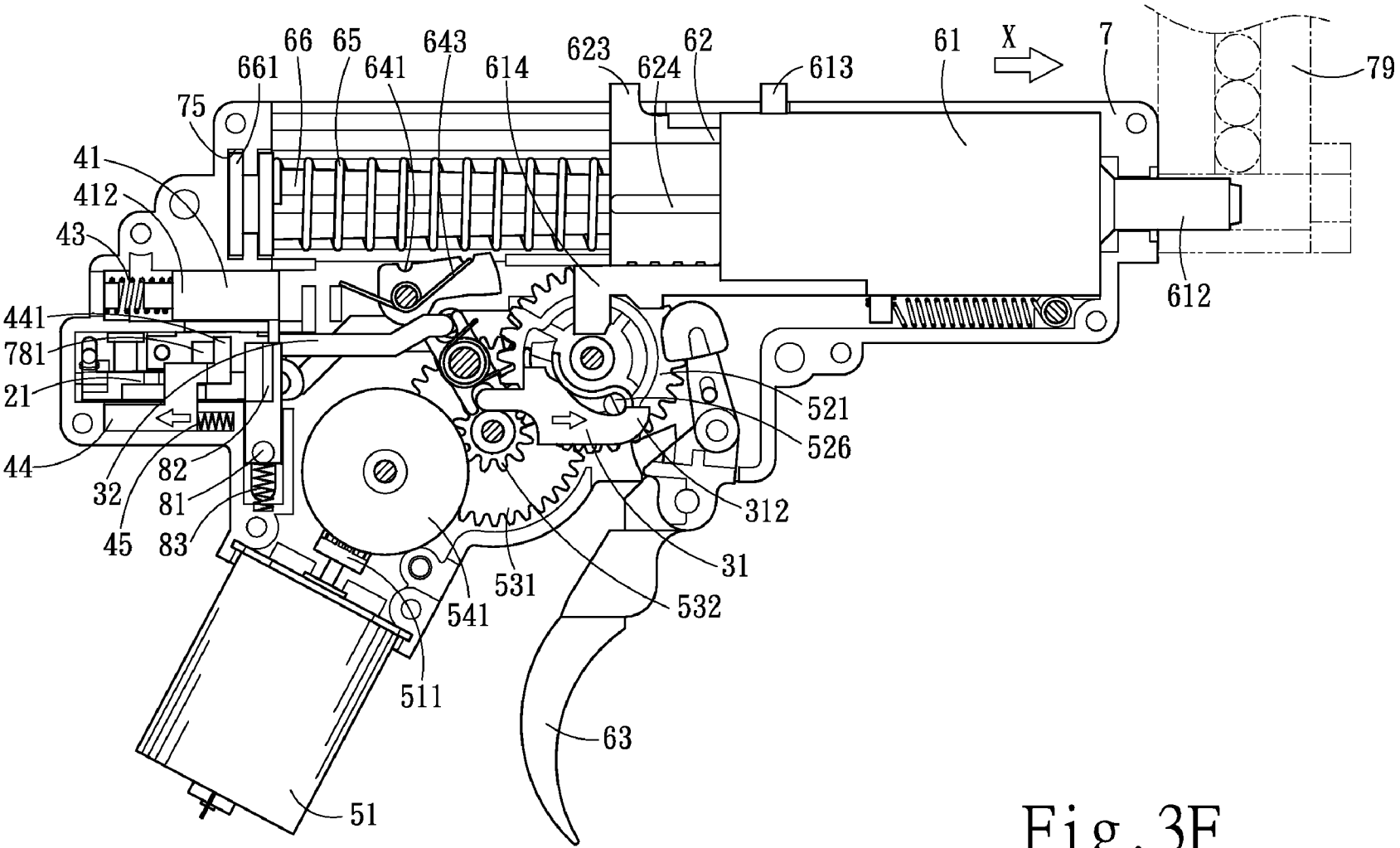
FIG. 3F is a fragmentary cross-sectional left-side view (III) of the electrically actuating toy gun structure of the invention.

FIG. 3A is a fragmentary cross-sectional left-side view (I) of the electrically actuating toy gun structure of the invention; FIG. 3B is a fragmentary cross-sectional plan view of the electrically actuating toy gun structure of the invention; FIG. 3C is a fragmentary cross-sectional left-side view (II) of the electrically actuating toy gun structure of the invention; FIG. 3D is a plan view of the first compound gear and the second interlocking rod of the electrically actuating toy gun structure of the invention (I); FIG. 3E is a plan view of the first compound gear and the second interlocking rod of the electrically actuating toy gun structure of the invention (II); while FIG. 3F is a fragmentary cross-sectional left-side view (III) of the electrically actuating toy gun structure of the invention. As shown in FIG. 3A~FIG. 3F, when the trigger (63) is pulled, the trigger (63) drives the first interlocking rod (1) to displace in reverse axial x-direction, and in sequence, drive the first push member (2) to make the connecting slider (21) displace, and in the meantime, by making use of the push-and-pluck member (22) to push the push-and-pluck rod (781) of the switch (78) so as to switch on the electric power supply (as shown in FIG. 3B), and in sequence, the transmission gear (511) of the shaft end of the electric motor (51) begins to rotate to drive the third compound gear (54) and the second compound gear (53), afterwards, after making the first compound gear (52) rotate, the interlocking salient pin (526) at the free end of the resilient cantilever (524) contained in the slot of first compound gear (52) will drive the L-shape draw bar (614) of the gun machine core tube (61) making it displace in x-direction to let the bullet (791), which is stored in the cartridge (79) at the front end of the gas nozzle (612) of the gun machine core tube (61), drop at the pre-determined position in front of the gas nozzle (612). Moreover, the half-gear (522) of the first compound gear (52) meshes with the lower rack (625) below the piston (62) to drive the piston (62) to displace in x-direction till propping up the location of the positioning slot (75) of the gun shell (7). Afterwards, the piston (62) is pushed by means of the resilient force of the piston spring (65) making the compressed air within the gun machine core tube (61) jet propel off and shoot off the bullet (791) stored within the cartridge (79) which is positioned in front of the gas nozzle (612) of the gun machine core tube (61); as the half-gear (522) separates from the lower rack (625), the interlocking salient pin (526) will separate the L-shape draw bar (614) owing to the exerting resilient force from the free end of the resilient cantilever (524) (see FIG. 3D and FIG. 3E). Moreover, the first compound gear (52) continues to rotate until the interlocking salient pin (526) contacts with the arcuate surface (312) of the draw bar (31) on the second interlocking rod (3), and in the meantime, rotates till it catches the hook portion (311) along the arcuate surface (312) to drive the draw bar (31) to displace in the reverse x-direction causing the push rod (32) slides along the x-direction to push the second push member (4). At this moment, the slider (44) having its bottom surface spread with grease of high viscosity is subjected to the action of the fourth position-restoring spring (45) to drive the push-and-pluck rod (781) of the power supply of the switch (78) by making use of the hook portion (441) to slowly slide along the x-direction for delaying the instant shut off of the power supply and avoiding the instant stop in action of the interlocking salient pin (526) soon after the power shut off. This is to avoid the phenomenon that the half-gear (522) of the first compound gear (52) and the lower rack (625) of the piston (62) stick together and are unable to make position restoration as shown in FIG. 3F making the plucking rod (421) of the push-and-pluck block (42) on the second push member (4) contacts with the push-and-pluck rod (781) of the switch (78) and cut off the power supply of the electric motor (51).

Thereafter, owing to the rotational inertia, the electric motor (51) makes the first compound gear (52) continues to rotate until the interlocking salient pin (526) collides the L-shape draw bar (614) again and generates reverse rotation. At this moment, the first compound gear (52) will not be stuck due to the resilient force retained in the resilient cantilever (524) making the positive position restoration of the gun machine core tube (61). What is more, when the electric motor (51) is started again, the situation that the half-gear (522) of the first compound gear (52) does not mesh well with the lower rack (625) below the piston (62) causing the partially retreated displacement and resulting in stuck bullet (791) or shooting off two bullet (791) at a time will not happen again.

Figure 4B:
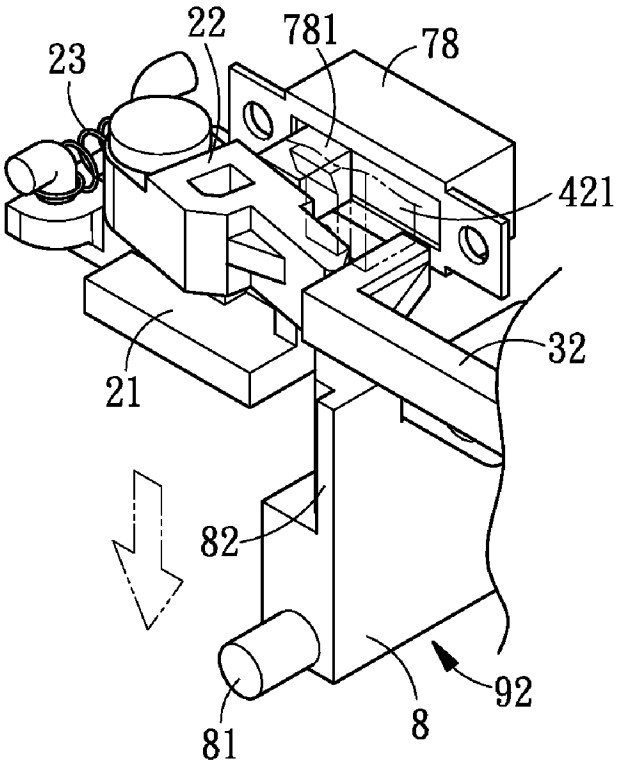
FIG. 4B is an isometric view showing the actuating action of the propping block at the second location of the invention.
Figure 4A:
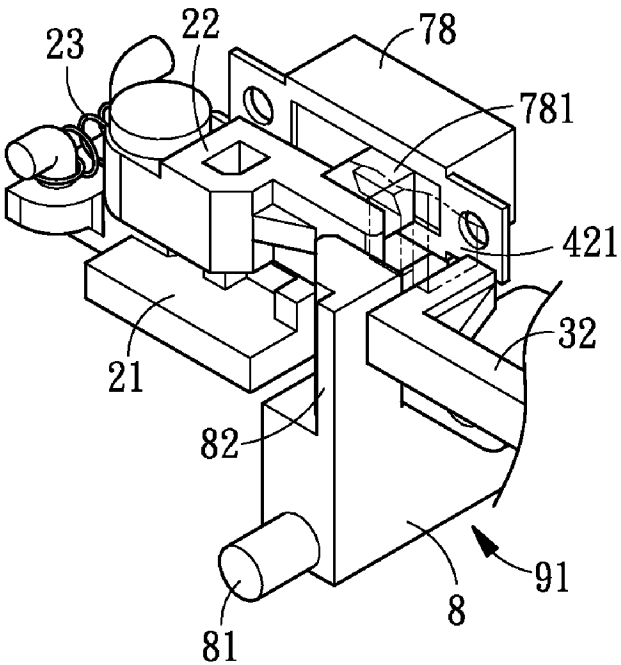
FIG. 4A is an isometric view showing the actuating action of the propping block at the first location of the invention.

FIG. 4A is an isometric view showing the actuating action of the propping block at the first location of the invention; FIG. 4B is an isometric view showing the actuating action of the propping block at the second location of the invention. As shown in FIG. 4A and FIG. 4B, when the push-and-propping-up block (8) locates at a first position (91), and the trigger (63) drives the first interlocking rod (1) and the first push member (2), the front end of the push-and-pluck member (22) of the first push member (2) slides forward and enter under the check portion (82) of the push-and-propping-up block (8); since the check portion (82) of the push-and-propping-up block (8) props up the push-and-pluck member (22) of the first push member (2) and since the push-and-pluck member (22) catches the push-and-pluck rod (781) of the switch (78), the plucking rod (421) of the push-and-pluck block (42) on the second push member (4) is unable to push the push-and-pluck rod (781) making the third position-restoring spring (422) contained therein compress to maintain the persistent switch-on condition of the switch (78) so as to make the control structure appears in the condition of continuing triggering. When the push-and-pluck salient block (81) of the push-and-propping-up block (8) is plucked down by a finger of the user making the push-and-propping-up block (8) moves till a second position (92) as shown in FIG. 4B, at this moment, the check portion (82) of the push-and-propping-up block (8) will no longer limit the push-and-pluck member (22) of the first push member (2). As a result, when the plucking rod (421) of the push-and-pluck block (42) on the second push member (4) pushes the push-and-pluck rod (781), the push-and-pluck member (22) is capable of pushing the push-and-pluck rod (781) backward to cut off the power supply of the switch (78) making the control structure appears in "single bullet shooting" condition.

In conclusion, it is known from the above-mentioned description that the improvement on the manually and electrically actuating toy gun structure of the invention lies in the fact that there is a resilient cantilever (524) furnished in the first compound gear (52) and there is also a interlocking salient pin (526) furnished at the free end of the resilient cantilever (524), as a result, when the first compound gear (52) rotates, the interlocking salient pin (526) is capable of driving the triggering device (6) for positive action, and when the first compound gear (52) reversely rotates, by making use of the resilient force of the resilient cantilever (524), the interlocking salient pin (526) is capable of separating the catching for keeping the positive meshing between the half-gear (522) of the first compound gear (52) and the lower rack (625) of the piston (62) to ameliorate the disadvantage of the prior art that the manually and electrically actuating toy gun structure is subject to have the problem of bullet sticking.

It will become apparent to those people skilled in the art that various modifications and variations can be made to the structure of the invention without departing from the scope or spirit of the invention. In view of the foregoing description, it is intended that all the modifications and variation fall within the scope of the following appended claims and their equivalents.

What is claimed is:

1. A manually and electrically actuating toy gun structure consisting of a gun shell, a trigger, a gun machine core tube, and a piston; and a control structure further consisting of a first interlocking rod, a first push member, a second interlocking rod, a second push member, a transmission set, a triggering device, a gun shell, and a push-and-propping-up block; the manually and electrically actuating toy gun structure comprising:

(a) the first interlocking rod having a connecting pin at one end and a connecting hole, which is connected to the trigger, at the other end, and the trigger is capable of driving the first interlocking rod to slide along the axial x-direction:

(b) the first push member being connected to the first interlocking rod and contacting with the push-and-pluck rod of the switch of a power supply to make the push-and-pluck member push the push-and-pluck rod so as to switch on the electric power supply when the first interlocking rod slides along the x-direction making the first push member being driven by the first interlocking rod to slide in axial direction and making the first push member push the push-and-pluck rod and switching on the power supply of a motor;

(c) the second interlocking rod, further including a draw bar, and a push rod; when a first compound gear of the transmission set rotates, the interlocking salient pin which is contained in the a of the first compound gear is capable of driving the L-shape draw bar along the x-direction making the push rod slide along the x-direction;

(d) the second push member further comprising a interlocking slider, a push-and-pluck block, a second position-restoring spring, a slider, and a fourth position-restoring spring;

(e) the transmission set further comprising an electric motor, a first compound gear, a second compound gear, and a third compound gear;

(f) the triggering device further comprising a gun machine core tube, a piston, a trigger, a pivoting block, a piston spring, and an inserting rod;

(g) the gun shell further comprising a carving hollowed-out portion, a motor connecting end, a front guiding slot, an inner guiding slot, a positioning slot, a control guiding slot, a switch containing chamber, and a switch; and (h) the push-and-propping-up block further comprising a push-and-pluck salient block, a check portion, and a compression spring;

wherein, when the power supply of the electric motor is turned off making the first compound gear generate reversed rotation, the first compound gear is capable of relieving the catching with the gun machine core tube to make the first compound gear positively mesh with the piston of the triggering device to perform action.

2. The manually and electrically actuating toy gun structure as claimed in claim 1 is characterized by that the second push member being connected to the push rod is adjacent to the switch; when the push rod slides in the reverse x-direction, the push rod pushes the second push member to slide in the reversed x-direction making the second push member pushes the push-and-pluck rod and making the turn-off of the switch and shut off the power supply of the motor.

3. The manually and electrically actuating toy gun structure as claimed in claim 1 is characterized by that the first compound gear of the transmission set has a resilient cantilever and a interlocking salient pin at the free end thereof, and the transmission set, the electric motor, as well as the piston of the triggering device are correspondingly interlocking.

4. The manually and electrically actuating toy gun structure as claimed in claim 1 is characterized by that when the power supply of the electric motor is switched on, the first compound gear performs a rotation making the piston of the triggering device be driven by the first compound gear; and the interlocking salient pin of the resilient cantilever on the first compound gear drives the draw bar backward to perform action making the bullet in the cartridge drop to the predetermined position; the disengaging of the lower rack of the piston from the first compound gear makes the piston revert to the original position; and the bullet is shot off by making use of the compressed air in the gun machine core tube.

5. The manually and electrically actuating toy gun structure as claimed in claim 1 is characterized by that the pivoting block of the triggering device has a catching teeth and a slant surface, the slant surface contacts with the first salient pin; when the piston is driven to displace in reversed x-direction, the catch teeth portion meshes with the catch slot; when the trigger is pulled, the first salient pin pushes the slant surface making the catch teeth portion separates from the catch slot and letting the piston displace in x-direction.

6. The manually and electrically actuating toy gun structure as claimed in claim 1 is characterized by that the first push member further comprising:

(a) a connecting slider being capable of performing axial sliding along the x-direction;

(b) a push-and-pluck member being pivotally connected to the connecting slider has its front end contact with and push the push-and-pluck rod when the connecting slider performs sliding; and (c) first position-restoring spring being connected to the connecting slider and push-and-pluck member making the push-and-pluck member persistently contact with the push-and-pluck rod.

7. The manually and electrically actuating toy gun structure as claimed in claim 1 is characterized by that the draw bar of the second interlocking rod has an arcuate surface and a hook portion; when the first compound gear rotates, the interlocking salient pin rotates to the hook portion and catches with the hook portion to drive the draw bar.

8. The manually and electrically actuating toy gun structure as claimed in claim 1 is characterized by that both ends of the second interlocking rod are connected to the draw bar and push rod respectively.

9. The manually and electrically actuating toy gun structure as claimed in claim 1 further comprising:

(a) a thin gear having a carving hollowed-out portion that is opposite to the resilient cantilever;

(b) a half-gear having a teeth portion on a side thereof that is adjacent to the carving hollowed-out portion, having a smooth circular arc on the other side thereof, and having a slot in between for containing the resilient cantilever; as the first compound gear rotates, the teeth portion is capable of meshing with the lower rack; and (c) a reinforced block being furnished at the carving hollowed-out portion for strengthening the stiffness of the thin gear.

10. The manually and electrically actuating toy gun structure as claimed in claim 1 is characterized by that the push-and-pluck block is adjacent to the first push member and the second push member and is for adjusting the push-and-propping-up block to control the switch of the power supply.

11. The manually and electrically actuating toy gun structure as claimed in claim 1 is characterized by that the slider being appeared in stepped shape has a hook portion at the top end thereof, and has a corresponding fourth position-restoring spring in the middle; the bottom portion of the slider being spread with high viscosity grease is subjected to the action of the fourth position-restoring spring; by making use of the hook portion to drive the push-and-pluck rod of the switch of the power supply to slowly slide backward in x-direction, one is capable of delaying the switch-off of the power supply; and the interlocking salient pin is capable of avoiding instantly stopping action to prevent the meshing between the half-gear of the first compound gear and the lower rack of the piston from mutually catching which may result in the inability of reverting position.

* * * * *